United States Patent [19]

Williams

[11] 4,162,094

[45] Jul. 24, 1979

[54] POLE BUILDING DOOR LOCK

[76] Inventor: Donald D. Williams, 415 W. Chapel St., Marengo, Ill. 60152

[21] Appl. No.: 848,945

[22] Filed: Nov. 7, 1977

[51] Int. Cl.[2] ..... E05C 19/18

[52] U.S. Cl. ..... 292/288

[58] Field of Search ..... 292/238, 288, 258, 293, 292/136, 291

[56] References Cited

U.S. PATENT DOCUMENTS

| | | | |
|---|---|---|---|
| 1,434,411 | 11/1922 | Silverstein | 292/291 |
| 2,775,001 | 12/1956 | Baker | 292/288 X |

*Primary Examiner*—Richard E. Moore

[57] ABSTRACT

A door lock for door structures such as used in buildings includes a U-shaped clamp member having an elongated hook portion adjustably supported longitudinally on one leg thereof. An angle plate with a hook receiving right is secured by screws to the door. The U-shaped clamp member is positioned about three sides of an upright post that forms part of the frame of the door structure so that the hook member projects laterally outwardly from the fourth side of the upright post for engagement with the hook receiving right. With the hook and ring engaged, the locking member is movable downwardly into biting engagement with the post to positively secure and hold the door against the door frame.

3 Claims, 5 Drawing Figures

POLE BUILDING DOOR LOCK

SUMMARY OF THE INVENTION

The door lock of the present invention is of simple and rugged construction, and is easily installed and assembled to tightly close the door of a pole building or the like against its associated door frame. The lock includes a U-shaped clamp member on which a hook portion is engageable with a hook receiving member mounted on the door. An angle plate of the hook receiving portion is the only permanently installed part of the door lock, as the U-shaped clamp member is completely free of the building when unlocked.

To assemble the lock of the present invention into a locked condition, the clamp member is fitted about the post of the door frame and the hook portion of the clamp member is engaged with the hook receiving member. Thereafter, the clamp member pivotably movable downwardly relative to the hook receiving member into biting engagement with the upright post of the door frame to tightly lock the door in a closed position. Any inward movement of the door by wind or other force simply causes the clamp member to slip further downward on the post, thereby progressively clamping the door tighter against the post. The clamp member is prevented from moving upward by the base portion of the clamp member which digs into the door frame post. Yet, the door lock is easily released when desired by simply pivoting the clamp member relative to the hook receiving member, to a horizontal position.

DETAILED DESCRIPTION OF THE PREFERRED EMBODIMENT

Figure 1:
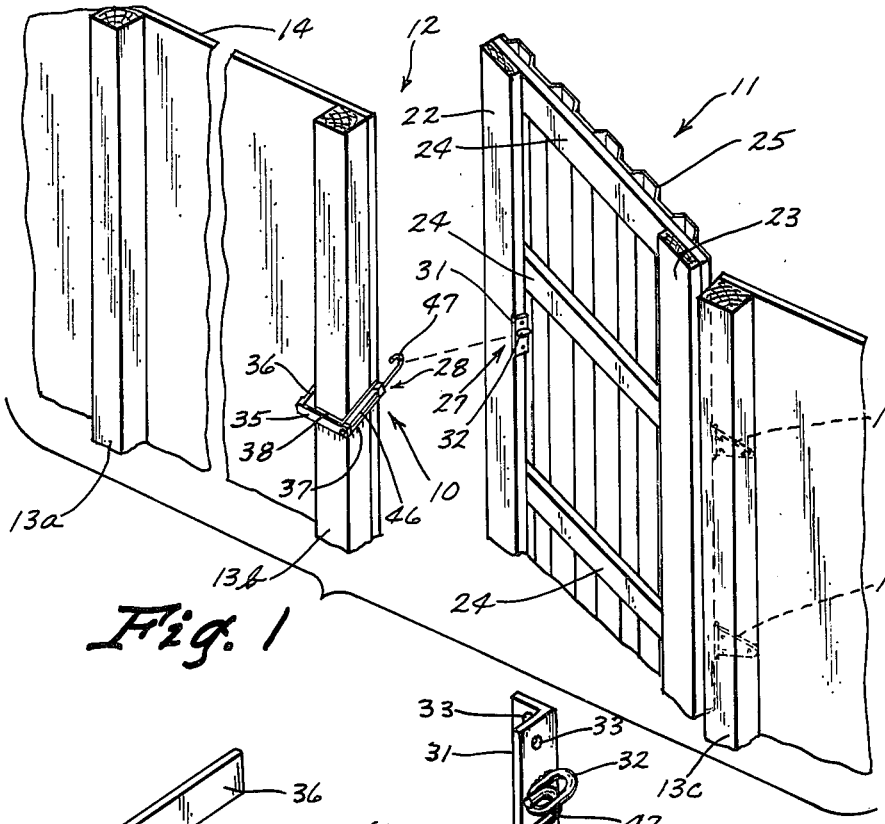
FIG. 1 is a perspective view of the door lock of the present invention shown in assembly relation with a fragmentary portion of a hinged door and sidewall of a pole building.

A preferred embodiment of the door lock of the present invention is shown in FIG. 1, indicated generally at 10, is shown with a door 11 of a pole building 12 (shown only fragentarily). The pole building 12 is of typical construction and includes a plurality of spaced apart, parallel upright posts 13*a*, 13*b*, and 13*c* defines an opening that is closed by the door 11, which is connected by hinges 19 to the post 18*c* for pivotal movement in a usual manner with respect thereto. The posts 13*b* and 13*c* and the portions of the siding 14 fastened thereto form a door frame for the door 11.

The door 11 is of standard construction that includes two upstanding spaced apart parallel side members 22 and 23 joined together by a plurality of cross members 24. Siding 25 covers the exterior surfaces of the cross members 22, and the hinges 19 are secured to one side of the door 11 by screws that extend through the siding 25 and into the cross members 23.

The door lock 10 includes a hook receiving member 27 mounted on the inner side portion of the upright member 22, and generally U-shaped clamp member 28 disposed about the upright post 13*b*.

Figure 2:
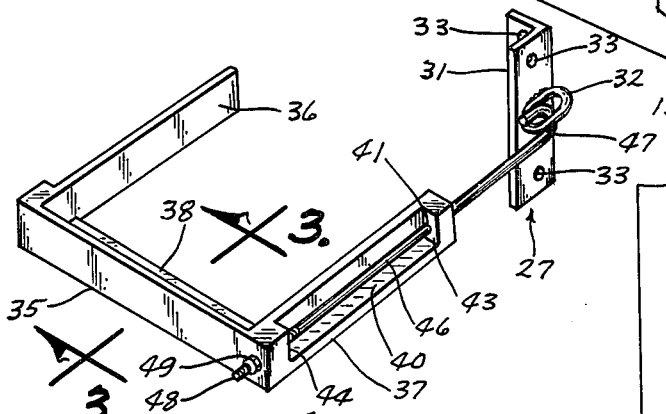
FIG. 2 is an enlarged perspective view of the door lock of the present invention.
Figure 5:
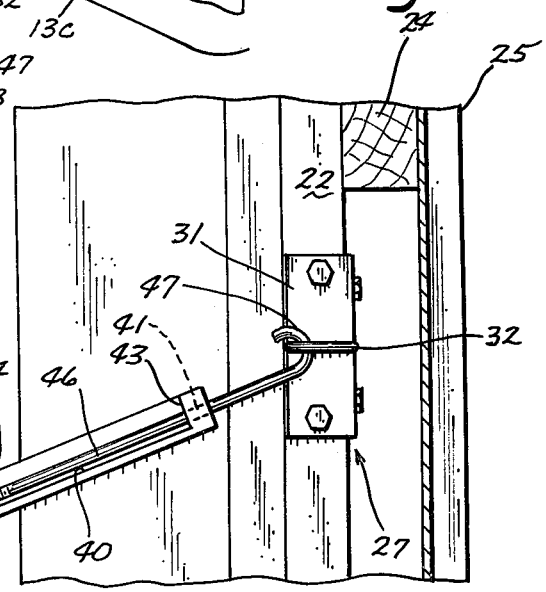
FIG. 5 is a side view of the door lock taken along line 5—5 in FIG. 4.
Figure 4:
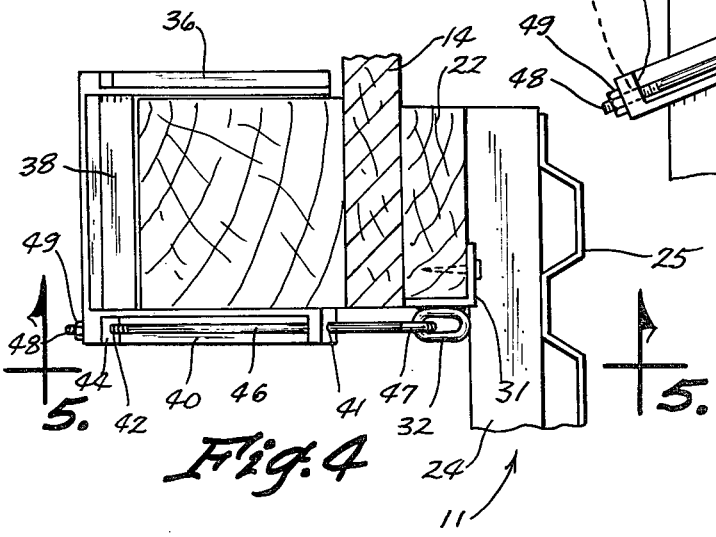
FIG. 4 is an enlarged plan view of the door lock of FIG. 1 showing the end portion of a hook member of the door lock engaged with a ring portion thereof.

Referring now to FIG. 2, the hook receiving member 27 includes an angle iron segment 31 having a ring portion 32 secured at a portion of its circumference to one side of the segment 31, as by welding. Formed in the angle iron 31 are several mounting holes 33 for receiving screws to fix the member 27 to the door 11 with the axis of the ring portion 32 vertically extended.

Figure 3:
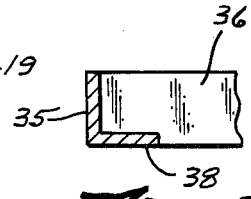
FIG. 3 is a cross sectional view taken along the line 3—3 of FIG. 2.

The U-shaped clamp member 28 includes a base 35, leg members 36 and 37 and a flange 39 along the bottom of the base 35 between the legs 36 and 37 (FIG. 3). An elongated recess 40 (FIG. 2) formed in the outer side of the leg member 37 has end walls 43 and 44 formed with axially aligned bores 41 and 42, respectively, and extended through the bores 41 and 42 is the shank 46 of a hook member having a hook portion 47 formed at one end for engaging the ring potion 32 of the hook receiving member 27. The terminal end 48 of the shank 46 is in threaded engagement with the side wall of the bore 42 for adjustment of the shank member 46 longitudinally with respect to the leg member 37. A lock nut 49 is onto the shank 46 which holds the hook member 42 in an adjusted position. Thus, it can be seen from the above description that the door lock 10 is of relatively simple structure, and as will now be described, the assembly of the lock 10 with the door is easily accomplished with a minimum of effort and time.

In assembly, and as shown in FIG. 1, the door 11 is first opened and the U-shaped clamp member 28 positioned about the post 13*b* so that the rod or shank member 46 projects toward the hook receiving member 27 which is carried on the door side member 22. With the door closed the rod member 46 is then adjusted with respect to the leg 37 to permit the hook portion thereof to be inserted through the ring portion 32 of the hook receiving member 27, while maintaining a clearance relation between the flange 39 of the base 35 and the post 18*b*. Thereupon, the clamp member 28 is released to permit it to be pivoted downwardly by gravity relative to the ring portion 32 until the flange 39 bites into the post 18*b*. In such position, the clamp member 10 holds the door 11 closed, and any movement of the door 11, such as by wind, merely causes the member 28 to pivot further downward to more securely close the door. However, to disengage the lock 10, it is only necessary to return the member 28 to a horizontal position, and unhooking the hook portion 47 from the ring portion 32.

Although the invention has been described with respect to a preferred embodiment thereof in use with a hinged door, it is to be understood that it is not to be so limited since changes and modifications such as the use of the invention with a sliding door can be made therein which are within the full intended scope of this invention as defined by the appended claims.

I claim:

1. A lock assembly and a door having a frame defining a doorway and including an upright post of a rectangular shape in transverse cross section at one side of the doorway, said lock assembly comprising:

(a) a clamp member of a U-shape and of a size to receive said post therein, (b) said post having a first side remote from the door, a second side opposite said first side, a third side facing the doorway and a fourth side opposite said third side, (c) said clamp member having a base section and a pair of leg sections to receive the post member in a straddling relation therebetween with the base section opposite said first side, with the one of said pair of leg sections opposite said third side having a hook portion projected laterally outwardly from said second side when the base section is in engagement with said first side, (d) a hook portion connecting member, and (e) means for securing said connecting member on the inner surface of the door such that when the door is in a doorway closing position, said hook portion is connectible with said connecting member to hold the base portion in engagement with said first post side.

2. The lock assembly according to claim 1, wherein:

(a) each of said pair of leg sections is of a length substantially equal to the width of an adjacent corresponding one of said third and fourth post sides to limit movement of said clamp member transversely of said doorway, and (b) means on said one leg section for adjusting said hook portion longitudinally thereof.

3. The door lock, according to claim 1, wherein:

(a) said hook receiving member includes a ring portion, and (b) said means for securing the hook receiving member to the door comprises:

(i) an angle plate engagable against said inner surface of the door, and (ii) means for securing the angle plate to the door.

* * * * *